US011417244B1

(12) United States Patent
Margulis et al.

(10) Patent No.: US 11,417,244 B1
(45) Date of Patent: Aug. 16, 2022

(54) ADJUSTABLE TAGGING SYSTEM

(71) Applicant: Etiflex Corp., Hallandale Beach, FL (US)

(72) Inventors: Norberto Julio Margulis, Aventura, FL (US); Alicia Gomelsky Margulis, Aventura, FL (US); Bruce Hoglander, Acworth, GA (US)

(73) Assignee: Etiflex Corp., Hallandale Beach, FL (US)

( * ) Notice: Subject to any disclaimer, the term of this patent is extended or adjusted under 35 U.S.C. 154(b) by 0 days.

(21) Appl. No.: 17/388,892

(22) Filed: Jul. 29, 2021

Related U.S. Application Data

(63) Continuation of application No. 16/834,564, filed on Mar. 30, 2020, now abandoned.

(60) Provisional application No. 62/829,900, filed on Apr. 5, 2019.

(51) Int. Cl.
*G09F 3/14* (2006.01)
*G09F 3/00* (2006.01)

(52) U.S. Cl.
CPC ..... *G09F 3/14* (2013.01); *G09F 3/005* (2013.01); *G09F 3/0295* (2013.01); *Y10T 24/2708* (2015.01)

(58) Field of Classification Search
CPC . Y10T 24/2708; Y10T 24/2733; Y10T 24/50; Y10T 24/505; A44B 18/0011; A44B 18/0015; A44B 18/0034; A44B 18/0038; A44B 18/0042; A44B 18/0061; A44B 18/0065; A44B 18/0057; G09F 3/14; G09F 3/0295; G09F 3/005
See application file for complete search history.

(56) References Cited

U.S. PATENT DOCUMENTS

| | | | |
|---|---|---|---|
| 7,013,536 B2 | 3/2006 | Golden et al. | |
| 8,490,882 B2 | 7/2013 | Margulis et al. | |
| 9,262,710 B2 | 2/2016 | Margulis et al. | |
| 2009/0031594 A1 | 2/2009 | Kosmin | |
| 2011/0265292 A1 | 11/2011 | Kirby et al. | |
| 2013/0193214 A1* | 8/2013 | Margulis | G06K 19/063 235/489 |

OTHER PUBLICATIONS

U.S. Appl. No. 62/829,900, filed Apr. 5, 2019.
U.S. Appl. No. 16/834,564, filed Mar. 30, 2020.

* cited by examiner

*Primary Examiner* — Cassandra Davis
(74) *Attorney, Agent, or Firm* — McCarter & English, LLP

(57) ABSTRACT

Products, systems and methods are provided for applying a tag or other label/indicia to an item, particularly an item with a circular, elliptical or irregular cross-section. The tag may take various forms. The tags may be secured to a variety of items, e.g., hoses, pipes, equipment, powered industrial units, and the like. The disclosed products, systems and methods allow the tag/label/indicia to be secured relative to the item in an easy and efficient manner. In addition, the securement mechanism includes cooperative mushroom style hooks and loops, and is generally susceptible to only a single use and is disabled and/or ineffectual if the securement is "reversed/undone" and reuse of the securement mechanism is attempted.

7 Claims, 5 Drawing Sheets

ADJUSTABLE TAGGING SYSTEM

1. CROSS-REFERENCE TO RELATED APPLICATIONS

The present application claims priority benefit to a non-provisional patent application entitled "Adjustable Tagging System" filed on Mar. 30, 2020, and assigned Ser. No. 16/834,564, which application in turn claimed priority benefit to a provisional patent application entitled "Adjustable Tagging System" filed on Apr. 5, 2019, and assigned Ser. No. 62/829,900. The entire contents of the foregoing non-provisional and provisional applications are incorporated herein by reference.

BACKGROUND

2. Technical Field

The present disclosure is directed to products, systems and methods for applying a tag or other label/indicia to an item, particularly an item with a circular, elliptical or irregular cross-section. The tag may take various forms, including those described in commonly assigned U.S. Pat. Nos. 9,262,710 and 8,490,882. The contents of the foregoing '710 and '882 patents are incorporated herein by reference. The tags may be secured to a variety of items, e.g., hoses, pipes, equipment, powered industrial units, and the like. The disclosed products, systems and methods allow the tag/label/indicia to be secured permanently relative to the item in an easy and efficient manner. In addition, the securement mechanism is generally susceptible to only a single use and is disabled and/or ineffectual if the securement is "reversed/undone" and reuse of the securement mechanism is attempted.

3. Background Art

In industrial environments, there is a widespread need to secure tags/labels/indicia to items having industrial use. Despite efforts to date, there remains a need in industrial applications to securely attach tags/labels/indicia with respect to such items. For example, traditional mechanisms for securing a tag/label relative to a unit in an industrial environment may involve a grommet and a mechanical fastener. However, when using such conventional securement mechanisms, the tag frequently and disadvantageously hangs off the item in a way that it could get caught and pulled off. In addition, rope and hose manufacturers/users desperately need a marking system that avoids metal fasteners because of the damage they can do to the fibers.

In addition, current default tags in the industry are generally stainless steel or other metal tag systems. In the oil & gas, petrochemical, and offshore marine industries, these conventional metal tags are a problem because, inter alia, the tag and fastening system can conduct electricity, can cause a spark and can cause a serious injury when falling from a height. With reference to the risk of injury, on a national basis, dropped and falling objects on job sites cause an average of 116 injuries a day.

Further, conventional "peel and stick" label systems, i.e., label systems that are pressure sensitive, suffer from numerous disadvantages in industrial practice. For example, adhesive-based label systems frequently are subject to shelf-life limitations, are susceptible to oil/solvent interactions that negatively impact adherence, may be susceptible to UV degradation, and provide securement that is neither secure (i.e., subject to removal) nor versatile (e.g., not effective for many items in an industrial setting).

Beyond the challenges associated with effectively securing a tag/label/indicia relative to an item in an industrial environment, it is also noteworthy that industrial items can range in diameter from inches to feet—so it is difficult to find an attachment system that works across the noted variability. It is further noteworthy that needs for secure tagging of items arises in non-industrial applications and environments, e.g., consumer environments/applications, medical environments/applications, educational environments/applications, residential environments/applications, and sporting/athletic environments/applications.

These and other challenges and limitations associated with conventional securement systems are addressed and overcome by the products, systems and methods disclosed herein.

SUMMARY

The disclosed products, systems and methods generally include (i) a tag, label or other indicia for use in industrial applications, and (ii) a securement mechanism that includes first and second cooperative elements. Of note, the disclosed products, systems and methods advantageously facilitate "no tool installation," i.e., securement of the tag, label or other indicia is readily achievable without the need for an additional/ancillary tool of any type (beyond the securement mechanism itself). Rather, the securement mechanism is easily achieved with a mere "tap" of the first cooperative element relative to the second cooperative element. The ability to secure a tag, label or indicia relative to an item as disclosed herein is highly advantageous from numerous perspectives, including specifically safety, cost, durability, convenience/flexibility and speed.

The disclosed systems/methods have wide ranging applicability in both industrial and non-industrial applications and environments. Exemplary non-industrial applications and environments include, but are not limited to, consumer environments/applications, medical environments/applications, educational environments/applications, residential environments/applications, and sporting/athletic environments/applications. However, use of the disclosed systems/methods is not limited by or to such exemplary environments/applications, but the use is unlimited in scope and application.

The cooperative first/second elements associated with the present disclosure generally take the form of at least one strap that is configured to be extended around the item to which the tag/label/indicia is to be secured, and a second element that may be engaged directly to the tag/label/indicia or that may be associated with a second strap. In implementations where both the first and second cooperative elements are associated with straps, the two straps generally cooperate to extend around the relevant item with an area of overlap where securement/engagement takes place.

The securement mechanism employs an advantageous hook-and-loop fastening mechanism wherein the hook is a "mushroom" style hook. More particularly, a first component of the disclosed securement mechanism includes an engagement region featuring mushroom style hooks—as contrasted with conventional fish hook shaped fasteners. A second component of the disclosed securement mechanism includes an engagement region featuring a deep and dense pile loop.

Of note, in conventional hook-and-loop engagement systems, the fish hook shaped fasteners are designed to "bend straight" (or substantially straight) to release the loop when separation is effectuated and, after separation, the fish hook shaped fasteners return to the original fishhook shape. In addition, separation of the fish hook shaped fasteners from a conventional loop region does not materially damage the loops and they remain effective for re-engagement with the fish hook shaped fasteners after initial disengagement. Thus, conventional hook-and-loop systems allow for the same components to be used repeatedly.

In distinct contrast, the mushroom style hooks of the first component of the present disclosure trap the loops of the second component under the many mushroom shaped heads of the fastener. With movement(s) of the first/second components, the loop(s) become more entwined in the mushroom hook(s) so that the bond gets stronger with time. By virtue of their shape, the mushroom style hooks are strong and do not bend or give way to release the loop if/when disengagement is attempted or a separation force is applied, thus forming a permanent bond therebetween. The only way to separate the two components is to significantly damage the loop(s) by ripping one end out or by tearing off the mushroom head (or both), thereby allowing the loop to release from the mushroom head, i.e., allowing disengagement of the first component from the second component. This release/disengagement is not possible with normal human strength and would require a force from a machine to tear the two components apart. Once separated, the damage to both components is significant so that another secure bond or attachment is not possible. Thus, the mushroom style hook/woven loop members of the present disclosure cooperate to form a secure bond when engaged, but are ineffective to create a secure bond a second time because the act of separation necessarily damages the loop and mushroom hook structures, making them ineffective for reengagement.

Of note, the disclosed mushroom hook-and-loop fastening mechanism may be fabricated from a fire retardant material, thereby enhancing the safety of the disclosed products/systems.

In exemplary embodiments of the present disclosure, one component of the fastening system is adhered or otherwise attached/joined to a tag/label/indicia, whether directly to a surface thereof or extending therefrom, e.g., by stitching of a strap that bears the noted component of the fastening system to the tag/label/indicia. Thus, the first component of the fastening system is generally adhered and/or otherwise attached/joined to the tag/label in a strategic manner, whereby the tag/label/indicia may be secured to an item by engaging the first component of the fastening system with the other component of the fastening system.

BRIEF DESCRIPTION OF THE FIGURES

To assist those of skill in the art in making and using the systems and methods of the present disclosure, reference is made to the appended figures, wherein.

DESCRIPTION OF EXEMPLARY EMBODIMENT(S)

Figure 1:
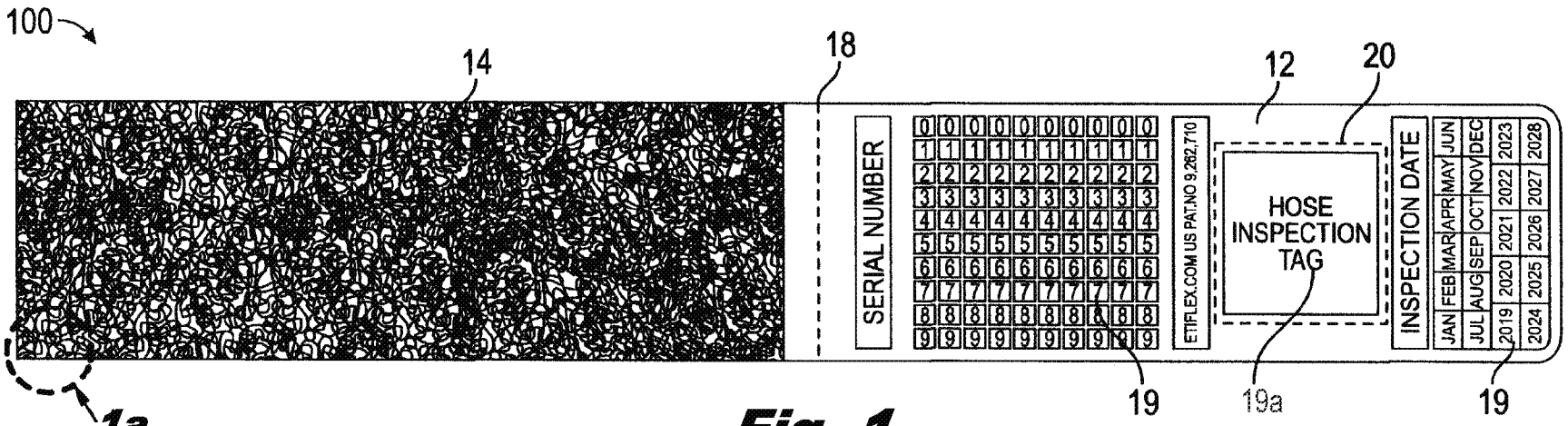
FIG. 1 is a top view of a tag system according to the present disclosure.

The disclosed system provides an advantageous solution for tagging/labeling a variety of items, including specifically synthetic ropes, fire hoses and other cylindrical shapes. The disclosed securement system may be employed to secure tags/labels/indicia of the types disclosed in commonly assigned U.S. Pat. Nos. 9,262,710 and 8,490,882, i.e., the tags make take the form of inspection tags, serial # and data tags and GHS tags using data matrix patented tags. Thus, according to the present disclosure, various modifications and/or refinements to the previously patented data matrix system may be incorporated/implemented, a range of adjustable, super durable tags/labels/indicia may be achieved that require no tools or metallic/additional fasteners and that can offer a "no tool" installation for any number of diameters. For example, laser etched modalities may be employed in connection with tags/labels/indicia according to the present disclosure.

The unique combination of materials and technology results in an original marking system that does what no other system can accomplish. It allows the user to permanently and securely mark a myriad of different products with an adjustable tag of common design/operation and without using any tools or additional fasteners. Additional benefits for the safety and inspection industries include the fact that once the tag/label/indicia is removed, it cannot be reused because the securement mushroom hooks and loops are ripped, thereby not allowing the tag/label/indicia to be moved to another item and ensuring compliance integrity. Benefits of the disclosed system/method thus include the following:

- "One Use Only" Security Feature—can't be reused once it is removed
- Fastens information to an item in a substantially permanent fashion
- Infinitely adjustable—can fasten to large range of sizes and shapes with dimensions from inches to feet
- No tools or additional fasteners (beyond the securement mechanism associated with the disclosed system) needed for installation
- Can be used indoor, outdoor, and in hazardous environments
- Resistant to most commercial cleaning products, common solvents, and petroleum products
- Excellent for inspections, serial numbers, and in-service date and tracking
- Facilitates data matrix recording system for updating information for life of the tag
- Facilitates secure attachment of a label/tag that can be marked, in whole or in part, after it is mounted to a desired item; for example, the label/tag can provide blank region(s) that may be marked (e.g., with a utensil such as a Sharpie) after it is attached to an item.

RFID technology can be included for tracking and inspections—in exemplary implementations, an RFID tag/transmitter may be sandwiched within or between securement elements according to the present disclosure, thereby providing a "label" in an electronic sense (as opposed to a written/visible label/indicia).

Tags can be laser etched or otherwise marked with desired information, e.g., laser-etched alpha-numeric characters 19 (FIG. 1), bar codes, QR codes, logos, and the like.

Tags can be or include printed labels/indicia 19*a* (FIG. 1).

Allows the user to permanently and securely mark a myriad of different products with an adjustable tag of common design (i.e., one size fits all) without using any tools or additional fasteners.

Figure 2:
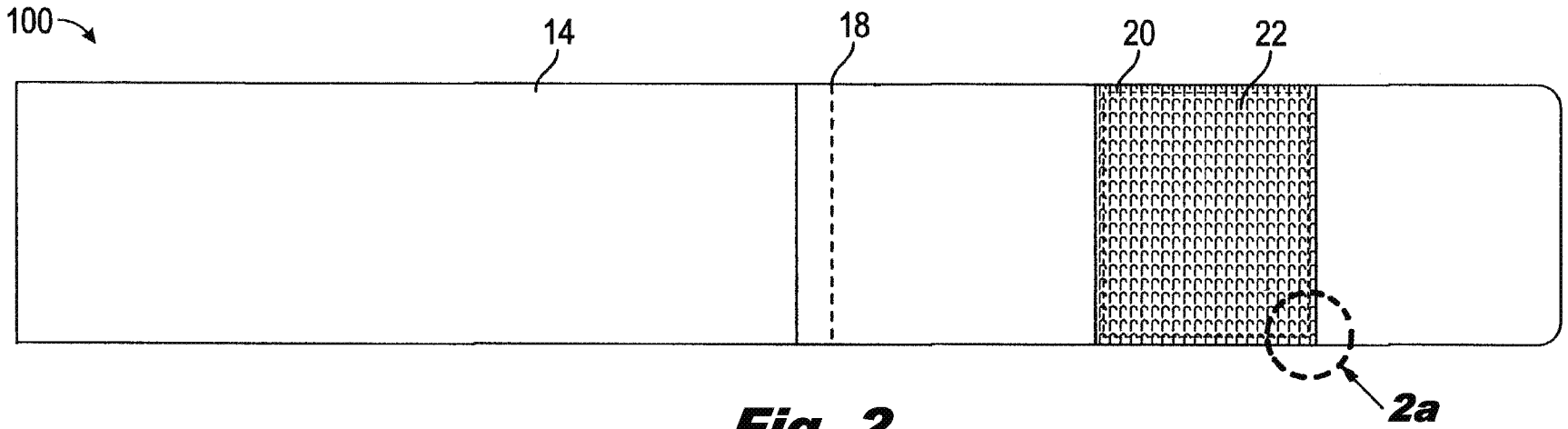
FIG. 2 is a bottom view of the tag system of FIG. 1.
Figure 3:
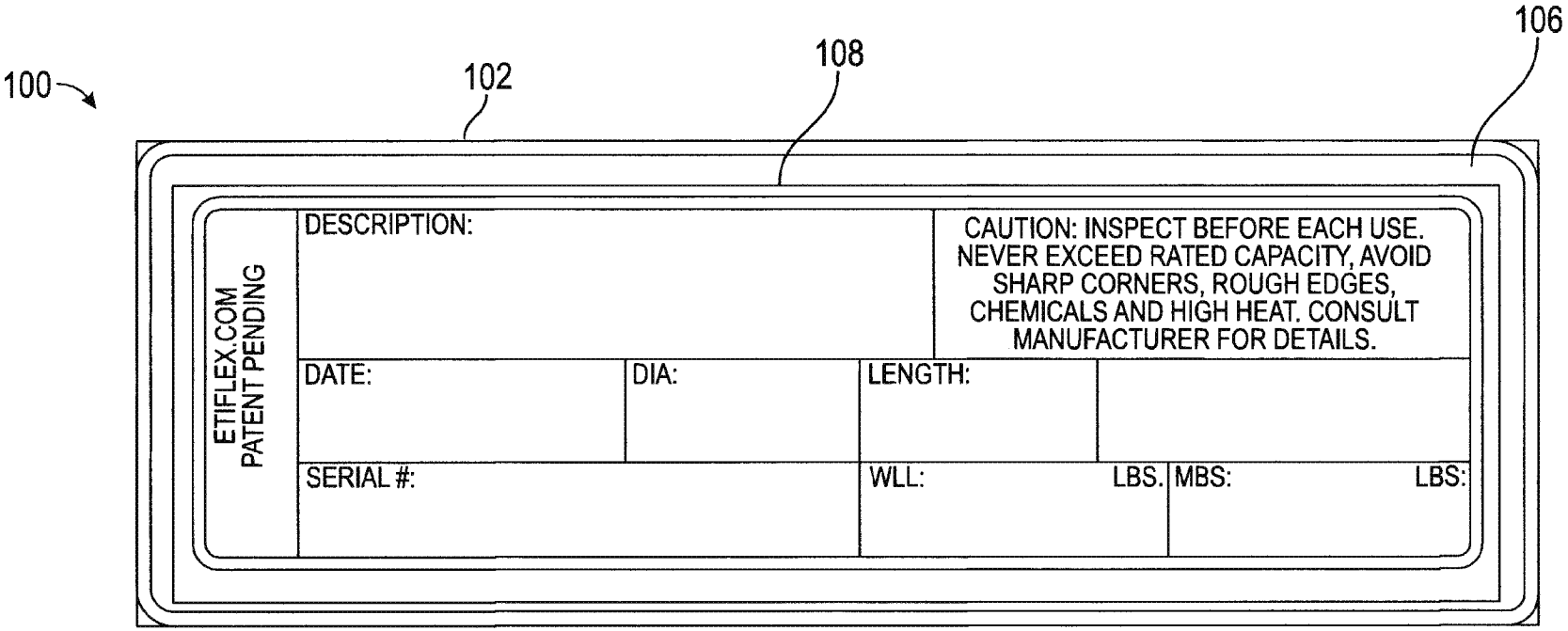
FIG. 3 is a top view of an alternative tag system according to the present disclosure.
Figure 4:
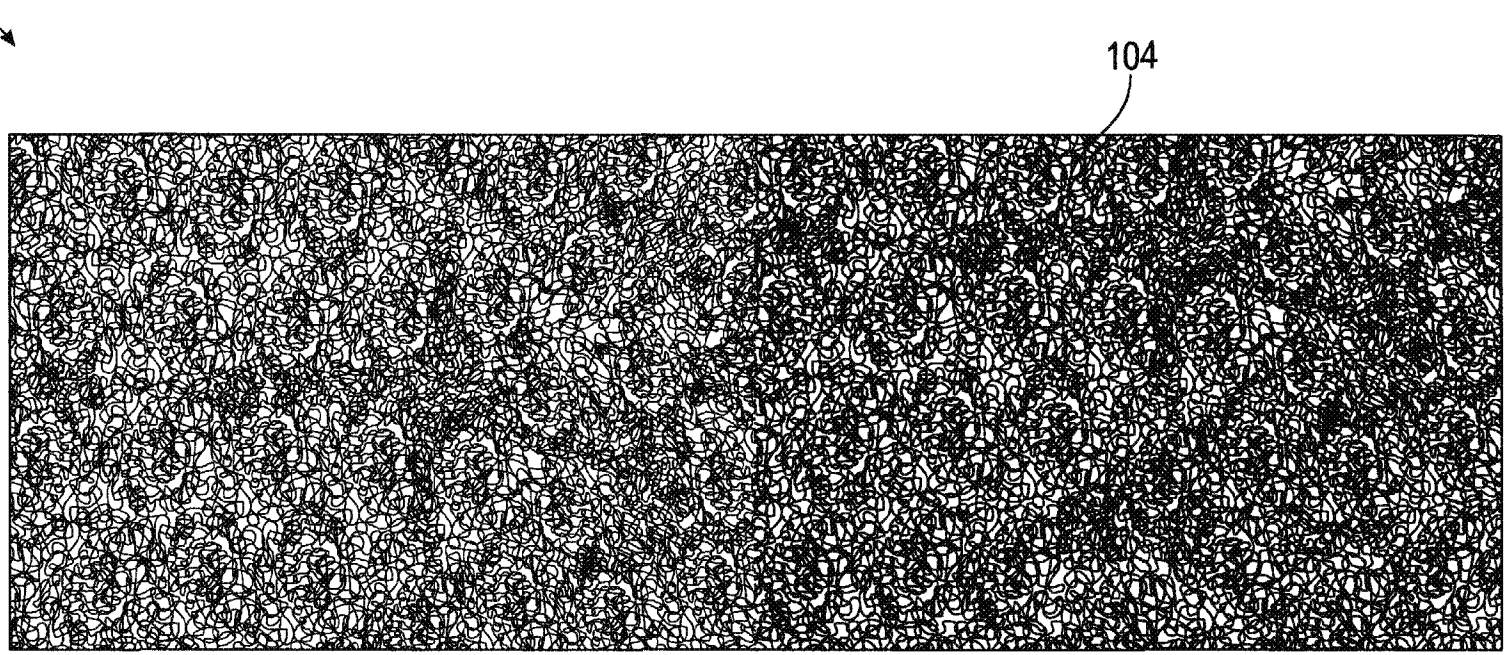
FIG. 4 is a bottom view of the tag system of FIG. 3.

With reference to the accompanying figures, FIGS. 1 and 2 are images of a first exemplary embodiment of the present disclosure, and FIGS. 3 and 4 are images of a first component of an exemplary securement mechanism adhered to a tag according to a second exemplary embodiment of the present disclosure.

As shown in FIG. 1 (top side) and FIG. 2 (underside), a tag system 10 is provided according to the present disclosure that includes a tag 12 and a strap 14 that is attached to the tag 12. In the exemplary embodiment of FIGS. 1 and 2, the strap 14 is joined to the tag 12 by adherence and stitching 18 adjacent an edge thereof. Stitching 18 securely joins the tag 12 and the strap 14 to each other. Of note, although the exemplary embodiment of FIGS. 1 and 2 illustrates an implementation wherein the tag 12 is stitched to the strap 14, the present disclosure is not limited by or to such attachment modality. Indeed, any effective technique for securing the tag with respect to the strap may be employed including, for example (in addition to stitching), attachment by way of adhesive(s), heat sealing, RF or sonic welding, or other mechanical attachment mechanisms (e.g., tongue-in-groove, bayonet lock, pin-in-slot attachment, and the like), and combinations thereof.

With particular reference to the underside of tag system 10 shown in FIG. 2, a second portion of the securement system takes the form of polygonal member 22—which in the exemplary embodiment of FIGS. 1 and 2 is approximately square in geometry—that is adhered and stitched to tag 12 by stitching 20. Of note, although the exemplary embodiment of FIGS. 1 and 2 illustrates an implementation wherein the geometry of element 22 is polygonal, the present disclosure is not limited by or to such geometry. Indeed, any geometry may be employed including, for example, circular, elliptical, and wholly irregular geometries, and combinations thereof.

Figure 2A:
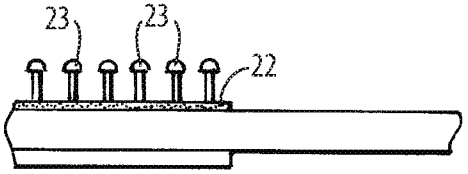
FIG. 2*a* is an exploded sectional side view of a second portion of the tag system of FIG. 2
Figure 1A:
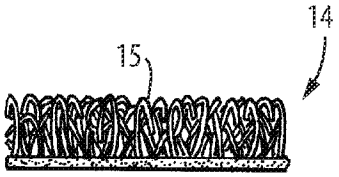
FIG. 1*a* is an exploded sectional side view of a first portion of the tag system of FIG. 1.
Figure 5A:
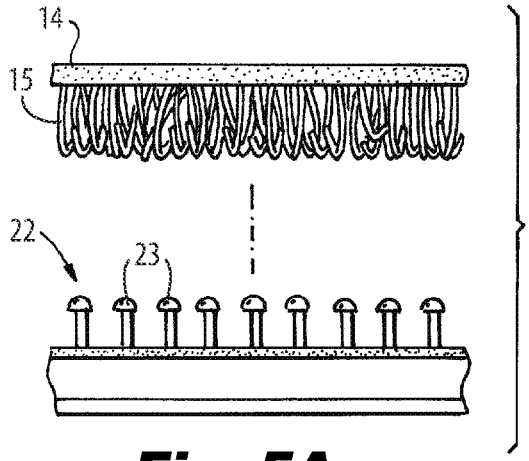
FIG. 5A is an exploded side view of a strap and cooperative member prior to engagement therebetween according to an exemplary embodiment of the present disclosure.
Figure 5B:
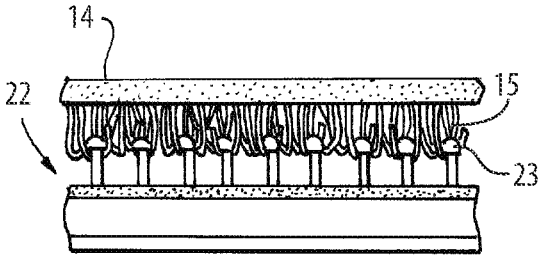
FIG. 5B is a side view of the strap and cooperative member of FIG. 5*a* engaged with each other according to an exemplary embodiment of the present disclosure.
Figure 5C:
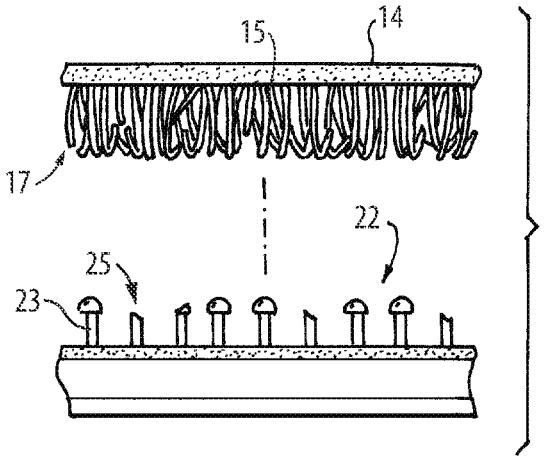
FIG. 5C is an exploded side view of the strap and cooperative member of FIGS. 5*a* and 5*b* after disengagement therebetween according to an exemplary embodiment of the present disclosure.
Figure 6:
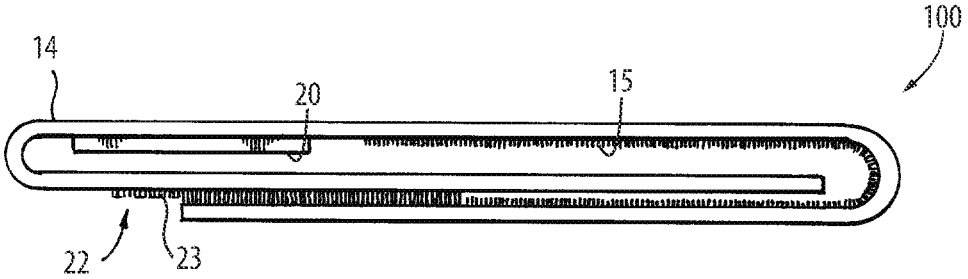
FIG. 6 is a side view of a tag system according to an exemplary embodiment of the present disclosure in which a strap and cooperative member are in engagement with each other.

The top face of strap 14 and the exposed face of member 22 feature cooperative mushroom style hooks 23 on one of strap 14/member 22 and cooperating loops 15 on the other of strap 14/member 22. In this way, strap 14 may be wrapped around an item and secured relative to member 22 by pressing the mushroom style hooks 23 into engagement with the cooperating loops 15 (see FIG. 6). Strap 14 and member 22 function as first and second securement members. FIG. 1*a* schematically depicts an exploded sectional side view of a first portion of strap 14 that shows a cooperating loops 15 associated with strap 14. FIG. 2*a* schematically depicts an exploded sectional side view of a second portion of strap 14 that shows mushroom style hooks 23 associated with member 22. Once engaged, the mushroom style hooks 23 securely engage the corresponding loops 14 (cf. FIG. 5A and FIG. 58). If the mushroom style hooks 23 are subsequently separated from the corresponding loops 14 (e.g., through mechanical means), the loops 15 and mushroom style hooks 23 are damaged (see, e.g., damaged mushroom style hook 25 and damaged loop 17 in FIG. 5C), such that attempted reengagement is ineffective to securely fasten the strap 14 relative to the member 22.

Turning to FIG. 3 (top side) and FIG. 4 (underside), an alternative tag system 100 is provided that includes indicia 106 on a top face of tag 102 and a securement member 104 on an underside thereof. The securement member 104 is adhered and stitched relative to tag 102 by stitching 108. The securement member 104 includes one of mushroom style hooks and cooperative loops. A second securement member (not pictured) would be used to secure tag system 100 relative to an item, as described with reference to tag system 10 of FIGS. 1 and 2, and would include cooperative loops (if securement member 104 includes mushroom style hooks) or mushroom style hooks (if securement member 104 includes cooperative loops). As with the embodiment of FIGS. 1 and 2, the present disclosure is not limited by or to the exemplary embodiment of FIGS. 3 and 4.

The disclosed system/method is described with reference to exemplary embodiments and implementations thereof. However, the present disclosure is not limited by or to such exemplary embodiments and implementations.

The invention claimed is:

1. A system for securing a tag, label or other indicia relative to an item, comprising:

a. a tag, label or indicia;

b. a first securement member attached relative to the tag, label or indicia; and c. a second securement member adapted to engage the first securement member;

wherein at least one of the first securement member and the second securement member includes a region with mushroom style hooks;

wherein at least one of the first securement member and the second securement member includes a region with loops adapted to engage with the mushroom style hooks;

wherein the first securement member is adapted to securely engage the second securement member based on engagement between the mushroom style hooks and the loops; and wherein once the first securement member is securely engaged with the second securement member, separation and attempted subsequent reattachment of the first securement member relative to the second securement member is ineffective to establish a secure attachment therebetween based on damage to the mushroom style hooks and the loops that occurs in the separation.

2. The system according to claim 1, further comprising a strap attached relative to the tag, label or indicia, and wherein the second securement member is associated with the strap.

3. The system according to claim 1, wherein the first securement member is stitched relative to the tag.

4. The system according to claim 1, wherein the tag, label or indicia takes the form of a printed or etched label.

5. A method for securely mounting a tag, label or indicia relative to an item, comprising:

a. providing a tag system that includes the tag, label or indicia, a first securement member that includes one of mushroom style hooks and loops adapted to engage with the mushroom style hooks, and a second securement member that includes loops adapted to engage with the mushroom style hooks if the first securement member includes mushroom style hooks, or mushroom style hooks if the first securement member includes loops adapted to engage with mushroom style hooks;

b. positioning the tag system relative to the item and securing the first attachment member relative to the second securement member;

wherein once the first securement member is securely engaged with the second securement member based on engagement between the mushroom style hooks and the loops, separation and attempted subsequent reattachment of the first securement member relative to the second securement member is ineffective to establish a secure attachment therebetween based on damage to the mushroom style hooks and the loops that occurs in the separation.

6. The method according to claim 5, wherein the tag system further comprises a strap attached relative to the tag, label or indicia, and wherein the second securement member is attached relative to the strap.

7. The method according to claim 5, wherein the tag, label or indicia takes the form of a printed or etched label.

* * * * *